US009693645B1

(12) United States Patent
Harripersad

(10) Patent No.: US 9,693,645 B1
(45) Date of Patent: Jul. 4, 2017

(54) SHOE REMOVAL ASSIST DEVICE

(71) Applicant: Dalchand Harripersad, Bronx, NY (US)

(72) Inventor: Dalchand Harripersad, Bronx, NY (US)

( * ) Notice: Subject to any disclaimer, the term of this patent is extended or adjusted under 35 U.S.C. 154(b) by 0 days.

(21) Appl. No.: 14/977,878

(22) Filed: Dec. 22, 2015

(51) Int. Cl.
*A47G 25/80* (2006.01)
*A47G 25/86* (2006.01)

(52) U.S. Cl.
CPC ..... *A47G 25/80* (2013.01); *A47G 25/86* (2013.01)

(58) Field of Classification Search
CPC ..... A47G 25/80; A47G 25/82; A47G 25/84; A47G 25/845; A47G 25/86; A47G 25/90
See application file for complete search history.

(56) References Cited

U.S. PATENT DOCUMENTS

| | | | | | |
|---|---|---|---|---|---|
| 8,865 | A * | 4/1852 | Thomson | A47G 25/80 | 223/117 |
| 19,844 | A * | 4/1858 | Goffin | A47G 25/80 | 223/116 |
| 48,122 | A * | 6/1865 | Wheeler | A47G 25/80 | 223/116 |
| 196,857 | A | 11/1877 | Aufdeeheide | | |
| 199,557 | A * | 1/1878 | Lauffer | A47G 25/80 | 223/116 |
| 250,655 | A * | 12/1881 | Gardner et al. | A47G 25/80 | 223/116 |
| 332,015 | A * | 12/1885 | Shalz | A47G 25/80 | 223/116 |
| 4,262,828 | A | 4/1981 | Kosakai | | |
| 4,394,946 | A | 7/1983 | McCormick | | |
| 5,566,868 | A | 10/1996 | Mariscal | | |
| 6,283,342 | B1 | 9/2001 | Wilkerson | | |
| 6,446,848 | B1 | 9/2002 | Swisher | | |
| 6,942,129 | B2 | 9/2005 | Ferraioli | | |
| 7,287,675 | B1 | 10/2007 | Sullivan | | |
| D659,948 | S | 5/2012 | Weakley | | |
| 2010/0264174 | A1 | 10/2010 | Anderson, Jr. | | |

FOREIGN PATENT DOCUMENTS

| | | |
|---|---|---|
| CN | 200939020 Y | 8/2007 |

* cited by examiner

*Primary Examiner* — Ismael Izaguirre
(74) *Attorney, Agent, or Firm* — Kyle A. Fletcher, Esq.

(57) ABSTRACT

The shoe removal assist device is a device that is adapted for use with shoes. The shoe removal assist device is a lever operated device that grips the heel of a shoe with a plurality of spikes. The plurality of spikes grip the shoe such that the shoe removal assist device holds the shoe in position and allows the wearer to remove their shoe from the foot. The shoe removal assist device is configured such that it can be operated from a standing position. The shoe removal assist device comprises a shoe grip, a shaft, and a handle.

12 Claims, 5 Drawing Sheets

SHOE REMOVAL ASSIST DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of devices for putting on or removing shoes, more specifically, a device adapted for the removal of shoes.

SUMMARY OF INVENTION

The shoe removal assist device is a device that is adapted for use with shoes. The shoe removal assist device is a lever operated device that grips the heel of a shoe with a plurality of spikes. The plurality of spikes grip the shoe such that the shoe removal assist device holds the shoe in position and allows the wearer to remove their shoe from the foot. The shoe removal assist device is configured such that it can be operated from a standing position.

These together with additional objects, features and advantages of the shoe removal assist device will be readily apparent to those of ordinary skill in the art upon reading the following detailed description of the presently preferred, but nonetheless illustrative, embodiments when taken in conjunction with the accompanying drawings.

In this respect, before explaining the current embodiments of the shoe removal assist device in detail, it is to be understood that the shoe removal assist device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the shoe removal assist device.

It is therefore important that the claims be regarded as including such equivalent construction insofar as they do not depart from the spirit and scope of the shoe removal assist device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
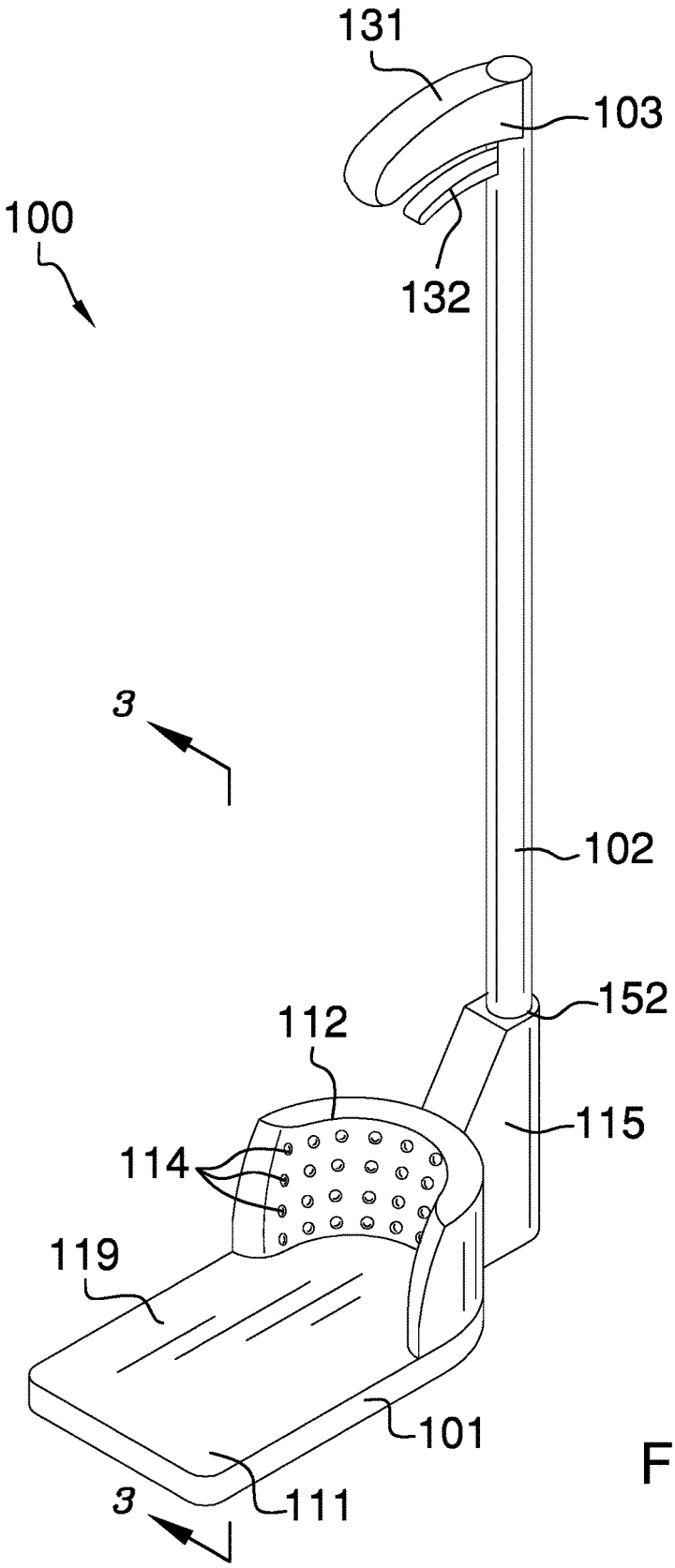
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5.

The shoe removal assist device 100 (hereinafter invention) comprises a shoe grip 101, a shaft 102, and a handle 103. The invention 100 is a device that is adapted for use with shoes 141. The invention 100 is a lever-operated device that grips the heel 144 of a shoe 141 with a plurality of spikes 113. The plurality of spikes 113 grips the shoe 141 such that the invention 100 holds the shoe in 141 position and allows the wearer to remove their shoe 141 from the foot 142. The invention 100 is configured such that it can be operated from a standing position.

Figure 5:
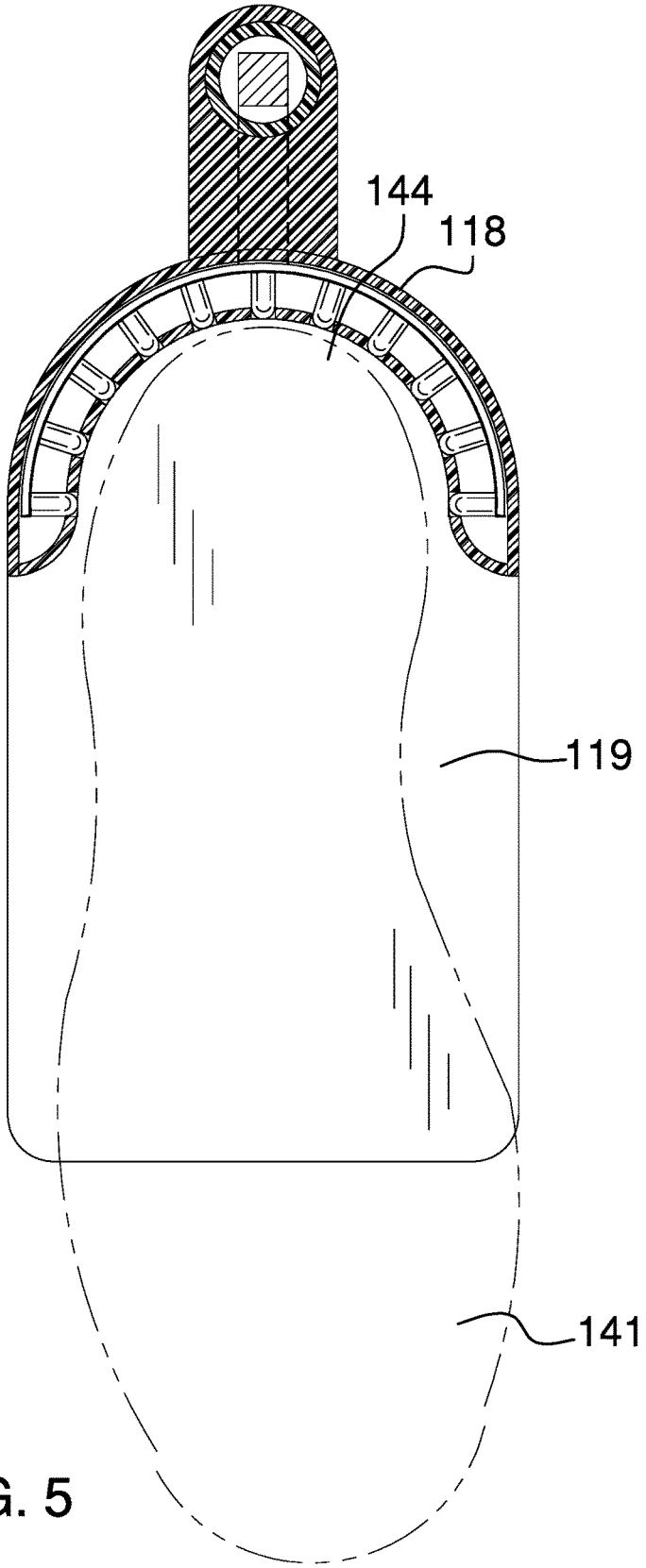
FIG. 5 is a cross-sectional view of an embodiment of the disclosure across 5-5 in FIG. 4.

The shoe grip 101 further comprises a base 111, a heel wall 112, the plurality of spikes 113, a plurality of spike holes 114, a spike plate 115, a linkage housing 116, and a spike plate wedge 117. The base 111 is the foundation of the shoe grip 101. The base 111 is the plate that sits on a support surface 143 and upon which the shoe 141 is placed. As shown in FIG. 5, the base 111 is further defined with a curved end 118. The horizontal surface 119 of the base 111 defines the location where the shoe 141 will be placed. The heel 144 of the shoe 141 is placed against the heel wall 112. The heel wall 112 projects perpendicularly away from the horizontal surface 119 of the base 111 around the curved end 118. The heel wall 112 has formed in it the plurality of spike holes 114. As shown most clearly in FIGS. 3 and 4, the plurality of spikes 113 and the spike plate 115 is contained with the heel wall 112. Each of the plurality of spikes 113 is a protrusion made from an elastomeric material that is attached to and extends from the face of the spike plate 115. Each of the plurality of spikes 113 is positioned on the spike plate 115 such that each of the plurality of spikes 113 is aligned with a hole selected from the plurality of spike holes 114.

The space contained within the heel wall 112 is connected to the space within the linkage housing 116 through an opening called the port 120. The linkage housing 116 is an apparatus that converts the vertical motion of the transfer strut 125 to horizontal motion in the spike plate 115. This linkage is provided using the spike plate wedge 117. When the transfer strut 125 moves down, the spike plate wedge 117 moves towards the heel wall 112 moving the spike plate 115 towards the heel 144 of the shoe 141. This motion of the spike plate 115 pushes the plurality of spikes 113 through the plurality of spike holes 114 bringing the plurality of spikes 113 in contact with the shoe 141. The friction of the contact between the plurality of spikes 113 and the shoe 141 holds the shoe 141 in position while the foot 142 is removed from the shoe 141. When the trigger 132 is released, the retraction of the transfer strut 125 returns the spike plate wedge 117, the spike plate 115, and the plurality of spikes 113 to each of their original positions.

The shaft 102 is a hollow tube that is used to separate the handle 103 away from the shoe grip 101. The shaft 102 further comprises a transfer strut 125. The shaft 102 further comprises a first end 151 and a second end 152. The transfer strut 125 is a cylindrical bar placed in the center of the shaft 102 such that the transfer strut 125 and the shaft 102 are aligned. The transfer strut 125 is the linkage between the operations of the shoe grip 101 to the operations of the handle 103. The transfer strut 125 is further defined with a third end 153 and a fourth end 154.

Figure 2:
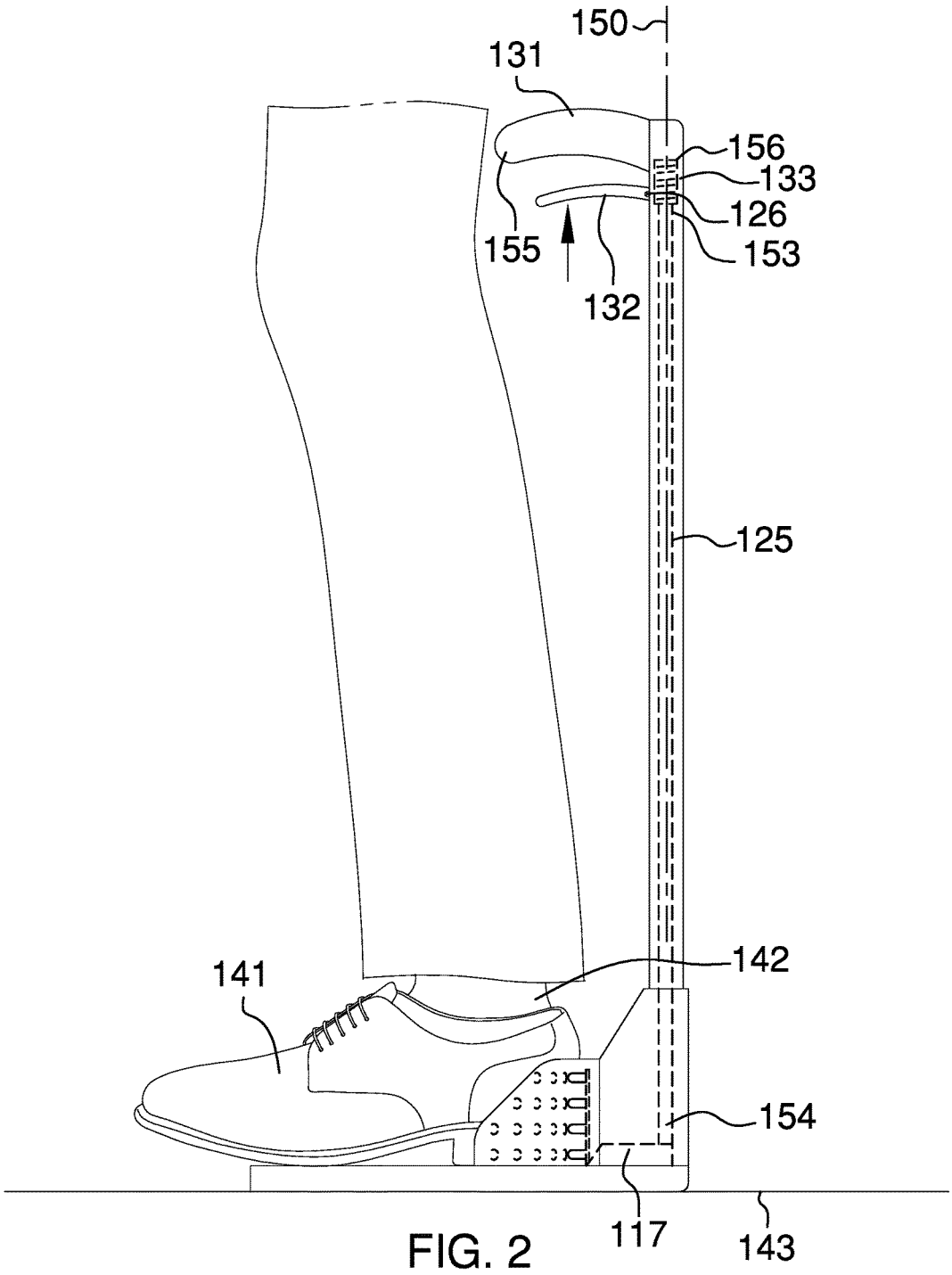
FIG. 2 is an in use view of an embodiment of the disclosure.
Figure 3:
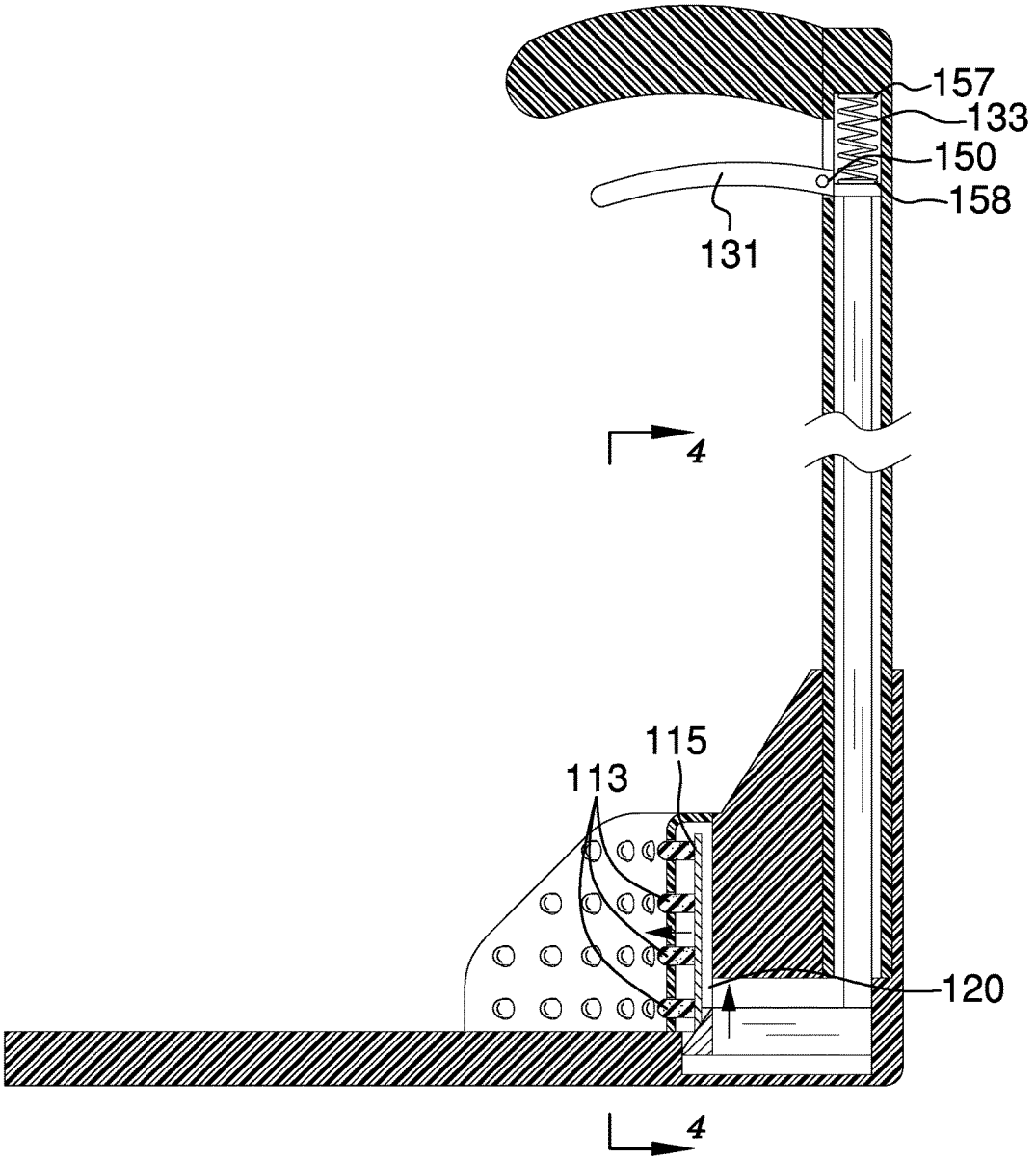
FIG. 3 is a cross-sectional view of an embodiment of the disclosure across 3-3 in FIG. 1.
Figure 4:
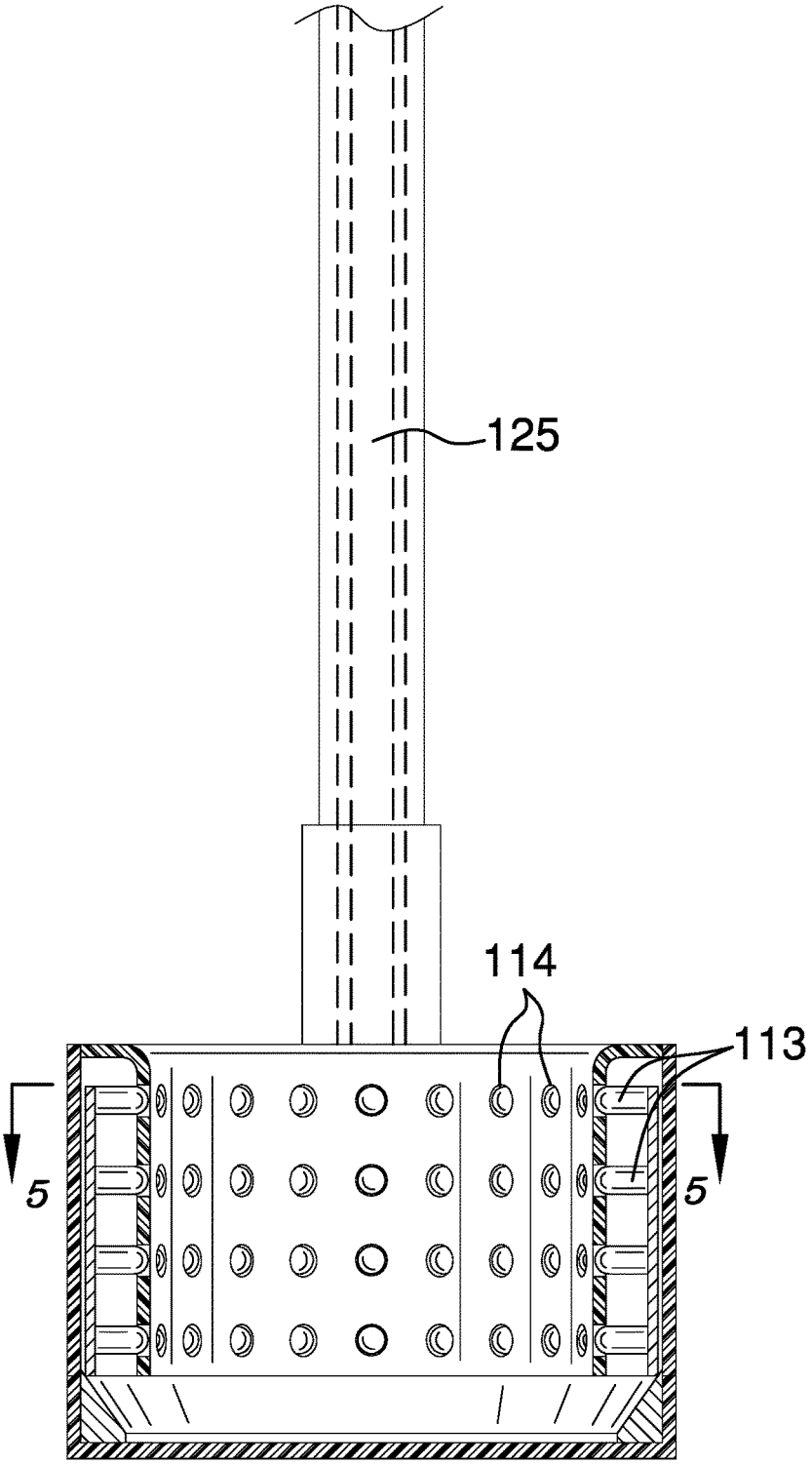
FIG. 4 is a cross-sectional view of an embodiment of the disclosure across 4-4 in FIG. 3.

The handle 103 further comprises a fixed grip 131, a trigger 132, and a return spring 133. The handle 103 is located at the first end 151 of the shaft 102. As best shown in FIGS. 2 and 3, the fixed grip 131 is a first handhold that projects perpendicularly away from the center axis 150 of the shaft 102. The trigger 132 is a second handhold that projects perpendicularly away from the center axis 150 of the shaft 102. The trigger 132 is further defined with a fifth end 155 and a sixth end 156. The sixth end 156 of the trigger 132 is attached to the third end 153 of the transfer strut 125. The trigger 132 is attached to a pivot point 126 such that when the fifth end 155 of the trigger 132 is pulled towards the handle 103 the sixth end 156 of the trigger 132 pushes the third end 153 of the transfer strut 125 towards the shoe grip 101. The return spring 133 is a helical coil tension spring that is further defined with a seventh end 157 and an eighth end 158. The seventh end 157 of the return spring 133 is attached to the handle 103. The eighth end 158 of the return spring 133 is attached to the sixth end 156 of the trigger 132.

When the fifth end 155 of the trigger 132 is pulled towards the fixed grip 131, the sixth end 156 of the trigger 132 moves away from the fixed grip 131 towards the shoe grip 101. This movement extends the return spring 133 thereby placing the return spring 133 under tension. When the trigger 132 is released, the return spring 133 releases the tension it is under by returning to its original position which in turn returns the sixth end 156 of the trigger 132 and the third end 153 of the transfer strut 125 returns to each of their original positions.

In the first potential embodiment of the disclosure, the fixed grip 131, the trigger 132, the base 111, the heel wall 112 including the plurality of spike holes 114, spike plate 115, and the linkage housing 116 are each formed from molded plastic. Suitable plastics include, but are not limited to, high density polyethylene or acrylic poly (methyl methacrylic). Each of the plurality of spikes 113 is made from polyurethane. The return spring 133 is a commercially available spring. The shaft 102 and the transfer strut 125 are commercially available tubes. The pivot point 126 and the spike plate wedge 117 are formed from commercially available hardware.

To use the invention 100, the shoe 141 is placed on the horizontal surface 119 such that the heel 144 is proximal to the heel wall 112. The trigger 132 is pulled towards the fixed grip 131 to securely hold the shoe 141 in position. The foot 142 is then removed from the shoe 141.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Center Axis: As used in this disclosure, the center axis is the axis of a cylinder like structure. When the center axes of two cylinder like structures share the same line they are said to be aligned. When the center axes of two cylinder like structures do not share the same line they are said to be offset.

Elastomeric Material: As used in this disclosure, an elastomeric material is a material that deforms when a force is applied to it and that is able to return to its original shape after the force is removed.

Handle: As used in this disclosure, a handle is an object by which a tool, object, or door is held or manipulated with the hand.

Inner Diameter: As used in this disclosure, the term inner diameter is used in the same way that a plumber would refer to the inner diameter of a pipe.

Outer Diameter: As used in this disclosure, the term outer diameter is used in the same way that a plumber would refer to the outer diameter of a pipe.

Tube: As used in this disclosure, a tube is a rigid hollow cylindrical device that is used for transporting liquids and gasses. The line that connects the center of the first base of the cylinder to the center of the second base of the cylinder is referred to as the axis of the cylinder or the centerline of the tube. In this disclosure, the terms inner diameter of a tube and outer diameter are used as they would be used by those skilled in the plumbing arts. A synonym of tube is pipe.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A device comprising:

a shoe grip, a shaft, and a handle;

wherein the device is adapted for use with a shoe;

wherein the device is lever operated;

wherein the device grips the heel of a shoe with a plurality of spikes;

wherein the plurality of spikes grips the shoe such that the device holds the shoe in position and allows a wearer to remove the shoe from the foot;

wherein the device is configured such that it can be operated from a standing position;

wherein the shoe grip further comprises a base, a heel wall, the plurality of spikes, a plurality of spike holes, a spike plate, a linkage housing, and a spike plate wedge;

wherein the base is the plate that sits on a support surface and upon which the shoe is placed;

wherein the base is further defined with a curved end;

wherein the heel wall projects perpendicularly away from the horizontal surface of the base around the curved end;

wherein the heel wall has formed in it the plurality of spike holes;

wherein the plurality of spikes and the spike plate is contained with the heel wall.

2. The device according to claim 1 wherein each of the plurality of spikes is a protrusion made from an elastomeric material.

3. The device according to claim 2 wherein each of the plurality of spikes is positioned on the spike plate such that each of the plurality of spikes is aligned with a hole selected from the plurality of spike holes.

4. The device according to claim 3 wherein the shaft is a hollow tube.

5. The device according to claim 4 wherein the shaft further comprises a transfer strut;

wherein the shaft further comprises a first end and a second end.

6. The device according to claim 5 wherein the transfer strut is a cylindrical bar placed in the center of the shaft such that the transfer strut and the shaft are aligned;

wherein the transfer strut is further defined with a third end and a fourth end.

7. The device according to claim 6 wherein the handle further comprises a fixed grip, a trigger, and a return spring.

8. The device according to claim 7 wherein the fixed grip is a first handhold that projects perpendicularly away from the center axis of the shaft.

9. The device according to claim 8 wherein the return spring is a helical coil tension spring that is further defined with a seventh end and an eighth end.

10. The device according to claim 9 wherein the trigger is a second handhold that projects perpendicularly away from the center axis of the shaft;

wherein the trigger is further defined with a fifth end and a sixth end;

wherein the sixth end of the trigger is attached to the third end of the transfer strut;

wherein the trigger is attached to a pivot point such that when the fifth end of the trigger is pulled towards the handle the sixth end of the trigger pushes the third end of the transfer strut towards the shoe grip;

wherein the seventh end of the return spring is attached to the handle;

wherein the eighth end of the return spring is attached to the sixth end of the trigger;

wherein when fifth end of the trigger is pulled towards the fixed grip, the sixth end of the trigger moves away from the fixed grip towards the shoe grip thereby placing the return spring under tension;

wherein when the trigger is released the sixth end of the trigger and the third end of the transfer strut both return to their original positions.

11. The device according to claim 10 wherein a port connects the contained within the heel wall to the space within the linkage housing.

12. The device according to claim 11 wherein the spike plate wedge converts the horizontal motion of the transfer shaft into the vertical motion of the spike plate.

* * * * *